US005216717A

United States Patent [19]

Bourcet et al.

[11] Patent Number: 5,216,717

[45] Date of Patent: Jun. 1, 1993

[54] FREQUENCY MODULATION BROADCAST TRANSMITTER SYNCHRONIZATION METHOD

[75] Inventors: Patrice Bourcet, Montlignon; Alain Komly, Paris; Michel Seguin, Buc, all of France

[73] Assignee: Telediffusion de France, Paris, France

[21] Appl. No.: 661,999

[22] Filed: Mar. 1, 1991

[30] Foreign Application Priority Data

Mar. 2, 1990 [FR] France ..... 90 02629

[51] Int. Cl.[5] ..... H04H 5/00

[52] U.S. Cl. ..... 381/3; 381/2; 455/3.2; 455/51.1; 375/107; 370/100.1

[58] Field of Search ..... 381/2, 3; 455/3, 6, 455/51, 3.2, 6.2, 51.1; 375/107; 370/100.1

[56] References Cited

U.S. PATENT DOCUMENTS

| | | | |
|---|---|---|---|
| 4,317,220 | 2/1982 | Martin . | |
| 4,608,699 | 8/1986 | Batlivala et al. . | |
| 4,688,210 | 8/1987 | Eizenhofer et al. | 375/107 |
| 4,821,260 | 4/1989 | Klank et al. | 381/2 |
| 4,972,410 | 11/1990 | Cohen et al. | 455/51 |
| 5,038,402 | 9/1991 | Robbins | 381/2 |

FOREIGN PATENT DOCUMENTS 2001230 1/1979 United Kingdom .

*Primary Examiner*—Jin F. Ng
*Assistant Examiner*—Edward Lefkowitz
*Attorney, Agent, or Firm*—Wegner, Cantor, Mueller & Player

[57] ABSTRACT

A synchronized broadcast network comprises a main transmitter transmitting an audio source signal to a plurality of receiver/transmitter units remote from each other and from the main transmitter, the receiver/transmitter units broadcasting the audio signal using frequency modulation. In the main transmitter the audio source signal is digitized by sampling it at a predetermined sampling frequency. A digitized signal representing the sampled audio signal is transmitted to the receiver/transmitter units. In each receiver/transmitter unit a reference signal representing the sampling frequency is derived from the received digitized signal and the received digitized signal is passed through a succession of digital processing stages including a stage in which a carrier derived from the reference signal is digitally modulated and a stage in which the result of the digital modulation is digital-to-analog converted. In one of the digital processing stages the received digitized signal is delayed for a predetermined time in order to synchronize the phase of the receiver/transmitter units. All the digital processing stages are synchronized to the reference signal to obtain identical digital modulation of the same carrier for all the receiver/transmitter units. The result of the digital-to-analog conversion stage is transposed to a final frequency derived from the reference signal for broadcasting the analog audio signal using frequency modulation with the same modulation, phase and carrier at all receiver/transmitter units.

4 Claims, 6 Drawing Sheets

FREQUENCY MODULATION BROADCAST TRANSMITTER SYNCHRONIZATION METHOD

BACKGROUND OF THE INVENTION

1. Field of the Invention

The invention concerns frequency modulation broadcast transmitter synchronization methods. Synchronizing two transmitters guarantees that the signals output by all the transmitters are identical except for their level and a constant time-delay.

The invention is more particularly concerned with a method of synchronizing a plurality of transmitters in a broadcast network comprising a program production site connected by transmission links to transmitters which are remote from the production site which transmits to each transmitter a baseband source signal representing the program, each transmitter broadcasting a final frequency modulation signal derived from the source signal by a number of processing steps.

2. Description of the Prior Art

In a network of frequency modulation transmitters broadcasting the same sinusoidal carrier (the same radio program, for example) the problem arises of mutual interference between the different transmitters, especially in transmission overlap areas in which the field levels are not very dissimilar and which are regarded as critical areas because reception quality is very poor. This problem is essentially due to the fact that, because of their varying distances from the production site, the transmitters do not receive the same source signal at the same time, given the analog nature of the transmitted signal and the propagation time required to transmit it from the production site to each transmitter; consequently, the transmitters do not transmit the same final signal at a given time. This problem is accentuated because, depending on their distance from adjacent transmitters, the critical areas do not receive the same signals at the same time, because of the propagation time needed to transmit the signal from a transmitter to the critical area. One solution to this problem is to use different transmission frequencies for each transmitter to cover the critical areas. This leads to high frequency usage, however, and the need for a mobile listener periodically to retune his receiver to the frequency of the transmitter offering the best reception conditions, in order to stay with the same program.

An experimental radio broadcast network developed by the Italian broadcasting authority RAI uses a network of synchronized transmitters. The production site is linked to each transmitter by a monomode optical fiber which transmits a signal modulated at the final transmission frequency, the modulated signal being obtained from a single modulator encoder located at the production site. The transmitters receive the same modulated signal and amplify it before it is broadcast. In this way the signals output by the transmitters are synchronized, each transmitter receiving at its input the same signal with a transmission delay which substantially compensates the broadcast delay provided that the broadcast direction is identical to the transmission direction. This solution has many drawbacks, however:

it is incompatible with existing broadcast network structures, it requires the use of a monomode optical fiber, in other words a costly infrastructure which is costly to install, it uses only a negligible part of the transmission capacity of the transmission medium, it requires a broadcast direction identical to the transmission direction.

The objective of the invention is to alleviate the drawbacks of the prior art and in particular to provide a network of synchronized frequency modulation transmitters using the conventional broadcast network structure, enabling simple and accurate adjustment of the phase alignment of synchronized signals at critical points in the service area, using equipment compatible with existing equipment enabling configuration and operation of the broadcast network in synchronized or non-synchronized mode, and in which the transmitters broadcast simultaneously a final signal at the same carrier frequency.

SUMMARY OF THE INVENTION

In one aspect, the present invention consists in a method for synchronizing receiver/transmitter units in a synchronized broadcast network comprising a main transmitter transmitting an audio source signal to a plurality of receiver/transmitter units remote from each other and from the main transmitter and the receiver/-transmitter units broadcasting the audio signal using frequency modulation, the method comprising the following steps:

in the main transmitter:

the audio source signal is digitized by sampling it at a predetermined sampling frequency;

a digitized signal representing the sampled audio signal is transmitted to the receiver/transmitter units;

and in each receiver/transmitter unit:

a reference signal representing said sampling frequency is derived from the received digitized signal;

the received digitized signal is passed through a succession of digital processing stages including a stage in which a carrier derived from the reference signal is digitally modulated and a stage in which the result of the digital modulation is digital-to-analog converted;

in one of the digital processing stages, the received digitized signal is delayed for a predetermined time in order to synchronize the phase of the receiver/-transmitter units;

all digital processing stages are synchronized to the reference signal to obtain identical digital modulation of the same carrier for all the receiver/transmitter units;

the result of the digital-to-analog conversion stage is transposed to a final frequency derived from the reference signal for broadcasting the analog audio signal using frequency modulation with the same modulation, phase and carrier at all receiver/transmitter units.

In another aspect, the present invention consists in a network for synchronized frequency modulation broadcasting of a stereophonic signal comprising a main transmitter in which a stereophonic source signal is generated and a plurality of receiver/transmitter units remote from each other and from the main transmitter receiving the stereophonic source signal to broadcast it using frequency modulation of a single carrier frequency, wherein the main transmitter comprises:

means for digitizing the stereophonic source signal by sampling it at a predetermined sampling frequency;

means for generating a synchronization signal;

means for encoding the digitized stereophonic source signal and the synchronization signal in the form of a digital broadcast signal which is transmitted to the receiver/transmitter units;

and each receiver/transmitter unit comprises:

means for receiving the digital transmission signal;

decoding means connected to the receive means to reconstitute the digitized stereophonic signal, the synchronization signal and a reference signal from the digital transmission signal, the reference signal representing said sampling frequency;

synthesizer means for generating synchronized synthesized carrier signals from the synchronization signal;

digital coding means receiving the digitized stereophonic signal and the synthesized carrier signals to provide a digital multiplex signal;

means connected to the decoding means to derive an intermediate frequency carrier signal and a control signal synchronized with each other from the reference signal;

digital modulation means receiving said intermediate frequency carrier signal and controlled by the delayed digital multiplex signal to provide a digital signal at the modulated intermediate frequency;

digital-to-analog converter means connected to the digital modulation means receiving the digital signal at the modulated intermediate frequency to provide an analog signal at the same intermediate frequency modulated in response to the digital-to-analog conversion signal;

transposition means controlled by the control signal to transpose the analog signal and the modulated intermediate frequency into a transmit analog signal at a final transmission frequency; and transmission means connected to the transposition means to broadcast said transmit analog signal using frequency modulation with the same modulation, phase and carrier at each receiver/transmitter unit.

Because the signal is transmitted in digital form, the signals received at the transmitters are sure to be identical apart from the transmission delay. Because a predetermined time-delay is applied to the broadcasting of the final signal at each transmitter, the phase of the signals transmitted to the critical areas can be synchronized.

Other characteristics and advantages of the invention will emerge more clearly from the following description and the appended drawings.

DETAILED DESCRIPTION OF THE INVENTION

Figure 1:
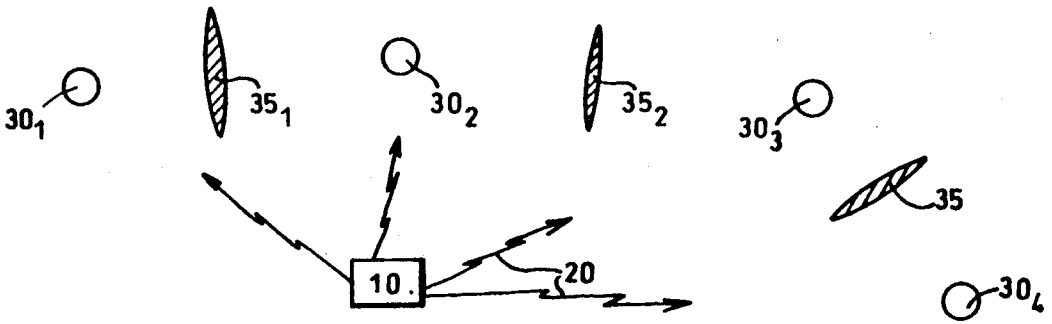
FIG. 1 is a diagram showing a radio broadcast network comprising a production site and a plurality of transmitters.

Referring to FIG. 1, a conventional broadcast network such as a radio broadcast network for example, essentially comprises a production site 10 connected by a transmission network 20 to a plurality of transmitters 30 remote from the production site, four transmitters being shown in this diagram. The transmission network 20 provides the links needed to distribute a baseband source signal to be transmitted and representing a program from the site 10 at which the signal is produced to each transmitter 30 from which a final signal is transmitted to the listeners. Each transmitter 30 has a respective coverage area (not shown) defined by the directional properties of its antenna. The coverage areas overlap in critical areas 35 where the mean field levels are not very different.

Figure 2:
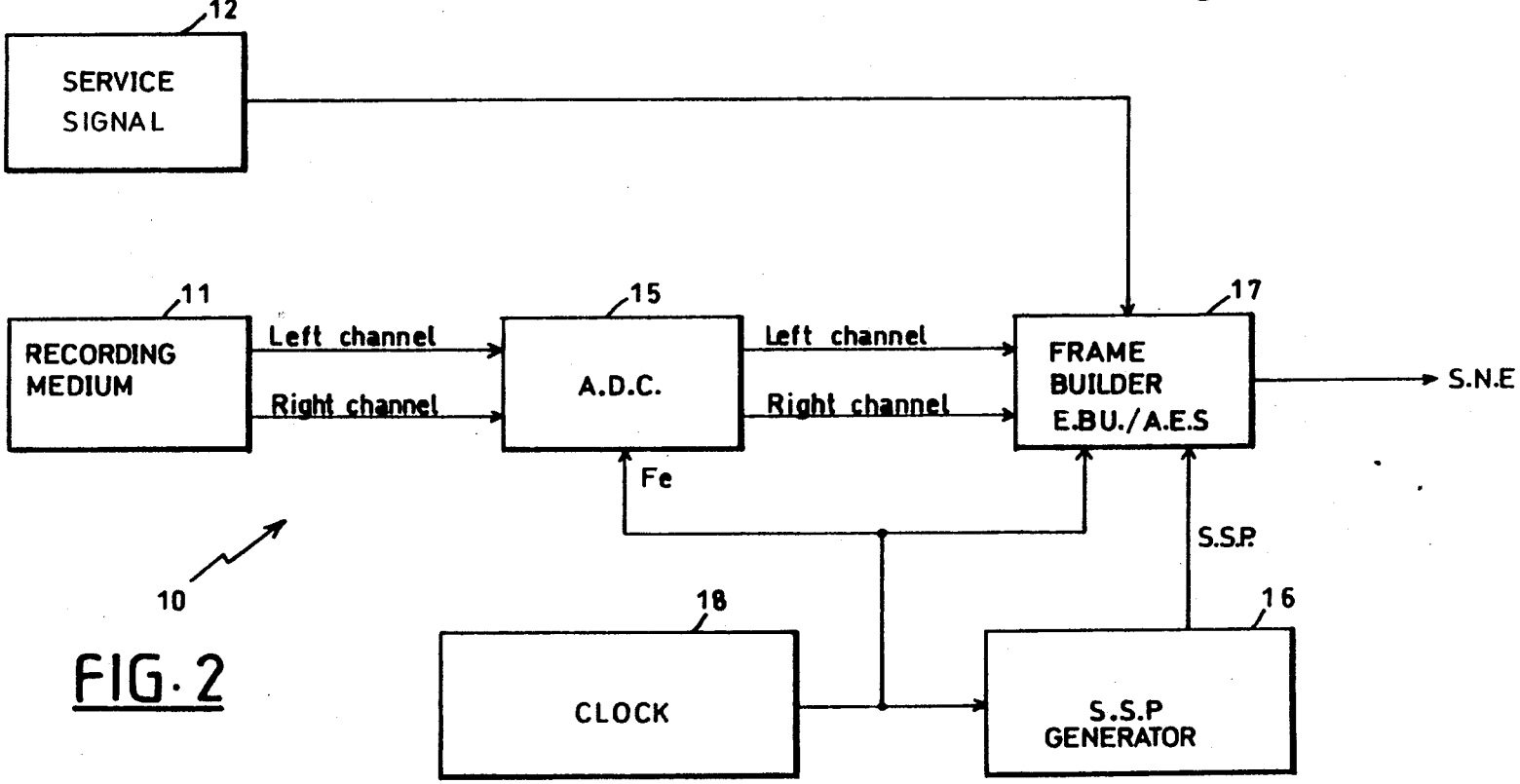
FIG. 2 is a functional block diagram of the production site.

Referring to FIG. 2, the production site 10 essentially comprises an analog-to-digital converter (ADC) 15 which digitizes the baseband source signal which is available, for example, in analog form on a recording medium 11 and which represents the program to be broadcast. The baseband source signal is digitized by sampling it at a specific sampling frequency Fe, for example 32 kHz. As shown in FIG. 2, the baseband source signal is a stereophonic signal comprising a left channel and a right channel, the ADC 15 supplying two series of binary values (left channel and right channel) each of which comprises Fe 16-bit values per second. The digital signals obtained at the output of the ADC 15 are formed into frames in which the left channel and the right channel alternate, in accordance with the EBU/AES standard, for example. The frame builder stage 17 following the ADC stage 15 converts the baseband signal into a serial digital transmit signal SNE complying with the EBU/AES standard. In the case of a stereophonic source signal the SNE signal includes a subcarrier synchronization signal SSP. The frame format is such that the SNE signal can also include service signals or data 12 appropriate to the transmission network. The SSP signal is a synchronization pulse signal at 1 kHz transmitted by means of the "user" bit provided in the EBU/AES standard format. The SSP signal is generated by a subcarrier synchronization signal generator 16. As shown in FIG. 2, the ADC 15, the frame builder 17 and the synchronization signal generator 16 are clocked at the same frequency and synchronously by a clock 18 generating a signal at the sampling frequency Fe.

Figure 3:
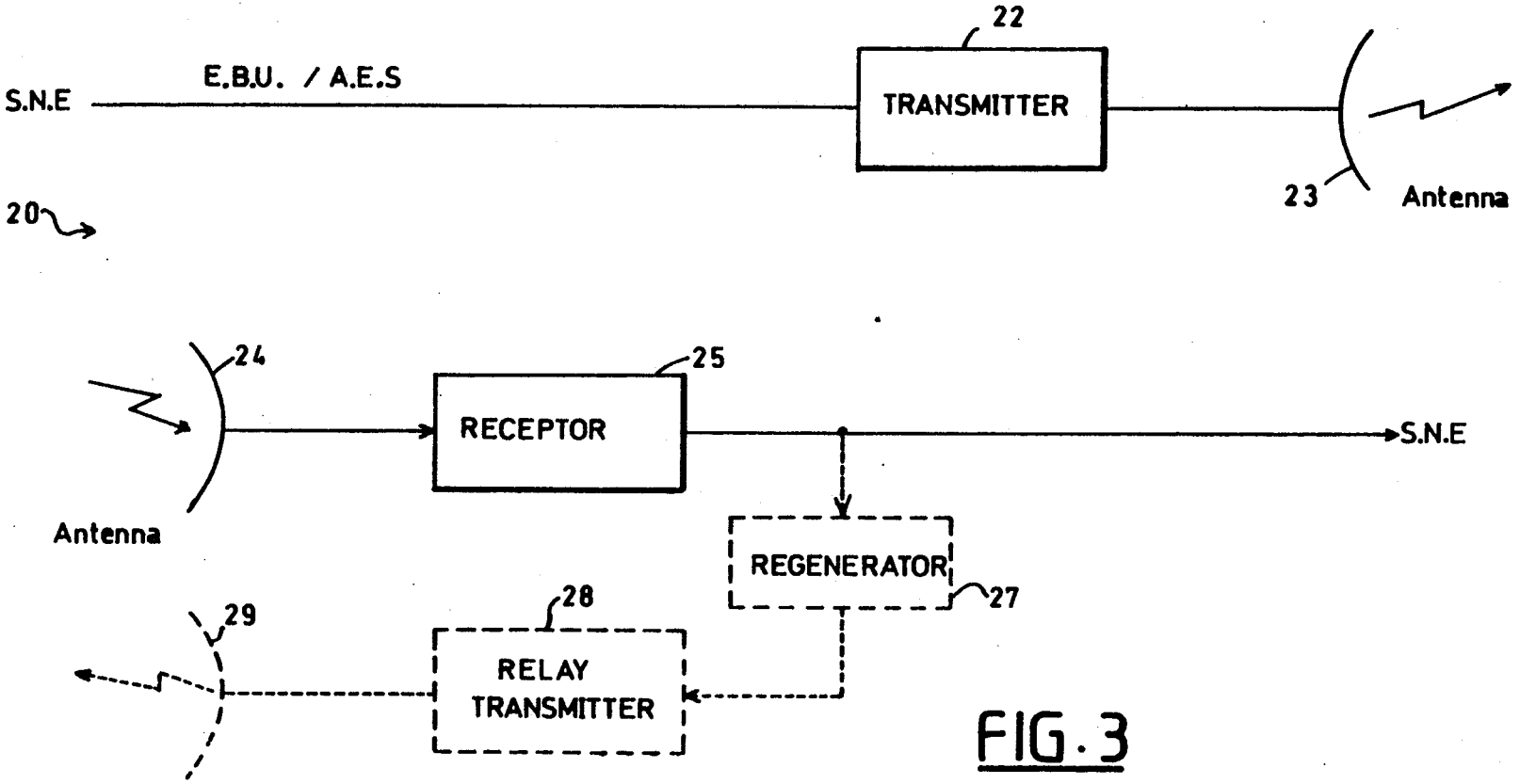
FIG. 3 is a functional block diagram of a digital transmission link between the production site and a transmitter.

The radio broadcast network comprises digital transmission links 20 as shown in FIG. 3. These digital transmission links convey the SNE signal from the production site 10 to each transmitter 30 and guarantee that the transmitters all receive the same digital signal. Any known type digital transmission medium may be used to this end, such as optical fiber, electric cable, microwave link or satellite link. In the case of a microwave link, it is sufficient to use a prior art transmission technique to frame the digital serial signal SNE at the head end of the transmission network to drive the beam direct via a transmitter 22 and an antenna 23. If the production site 10 is connected to each transmitter 30 via a digital transmission link 20 a star network is obtained as shown in FIG. 1. If the signal to be transmitted is transmitted in successive hops from the production site 10 to the first transmitter and then from this transmitter to the second transmitter, and so on, a linear network is obtained. In the case of linear transmission, a regenerator 27 is provided, connected to a relay transmitter 28 and an associated antenna 29 so that as many hops as needed can be made without deterioration of the signal to be transmitted. In practice a broadcast network may include a mix of these two configurations, but in any event a radio broadcast network in accordance with the invention comprises a single production site 10 at which the baseband source signal is digitized once only.

The equipment providing the digital transmission link 20 is divided between the production site 10 and the transmitters 30. As shown in FIG. 3, a transmitter 30 can include the equipment 27, 28, 29 necessary to relay (retransmit) the SNE signal in the case of linear transmission.

Figure 4:
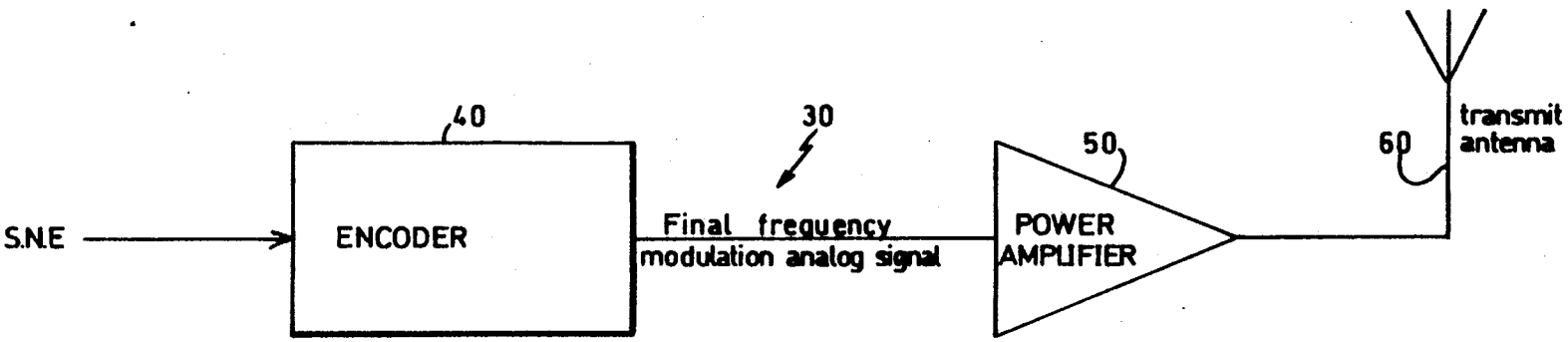
FIG. 4 is a functional block diagram of a transmitter incorporating a modulator encoder in accordance with the invention.

Referring to FIG. 4, in addition to the equipment implementing the operations described above, each transmitter 30 comprises a synchronizable modulator encoder 40 receiving at its input the SNE signal. The synchronizable modulator encoder 40 processes the SNE signal in a number of stages to produce a final frequency modulation analog signal at a final transmission frequency which is the same for each transmitter and is between 88 and 108 MHz, for example. The final analog signal is finally amplified by a power amplifier 50 rated to provide the output power required for a transmit antenna 60 according to the specifications of the transmission site. It will be understood that synchronization is applied only if several transmitters operate simultaneously on the same transmission frequency.

Each transmitter 30 nominally receives the same SNE signal from the production site 10. The transmission time to each transmission site is different, which means that the SNE signal is received by each transmitter with a different time-delay. However, apart from this time-delay, the SNE signals received by the transmitters 30 are identical by virtue of their transmission in digital form. In the case of a stereophonic baseband source signal, the phase of the subcarrier synchronization signal SSP introduced into the SNE signal is identical at each transmission site at which the SNE signal is received.

The remainder of this description is concerned entirely with a stereophonic baseband source signal.

The SNE signal received by the transmitter 30 is passed to the synchronizable modulator encoder 40. The synchronization of the modulator encoder 40 involves programming a final signal "transmit delay" which compensates the SNE signal "receive delay" at each transmitter 30 and the "receive delay" of the signal transmitted to the critical area. The modulator encoder 40 has a digital part 40A in which digital processing is carried out on the SNE signal to provide a control signal and an analog signal for frequency modulation of a carrier at an intermediate frequency Fi of 10.7 MHz, for example, and an analog part 40B receiving said analog frequency modulation signal and said control signal in which analog processing is carried out on said analog signal to provide the final analog signal to be frequency modulation broadcast on the final carrier at the final frequency.

Figure 5:
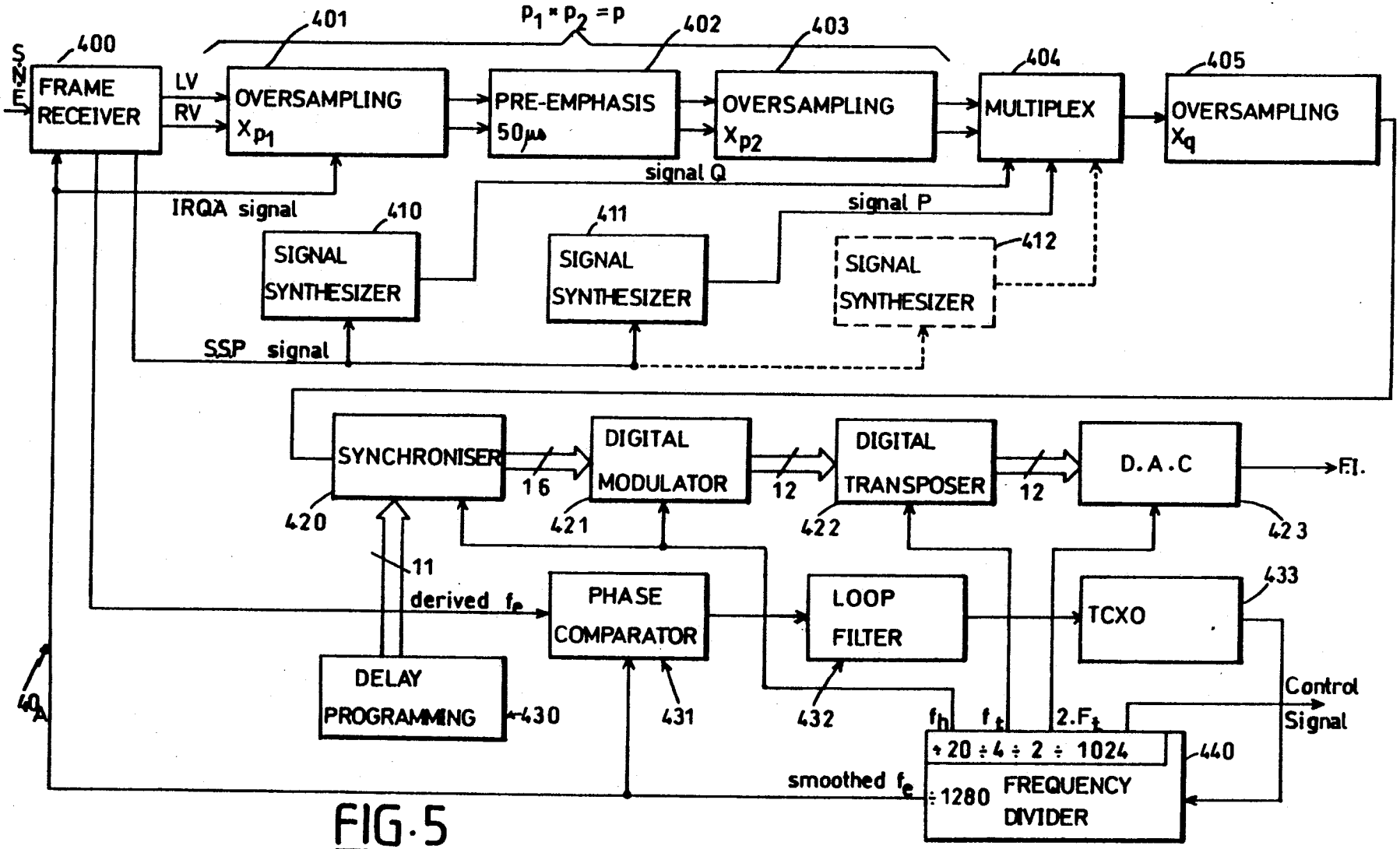
FIG. 5 is a functional block diagram of the digital part of the modulator encoder shown in FIG. 4.
Figure 6:
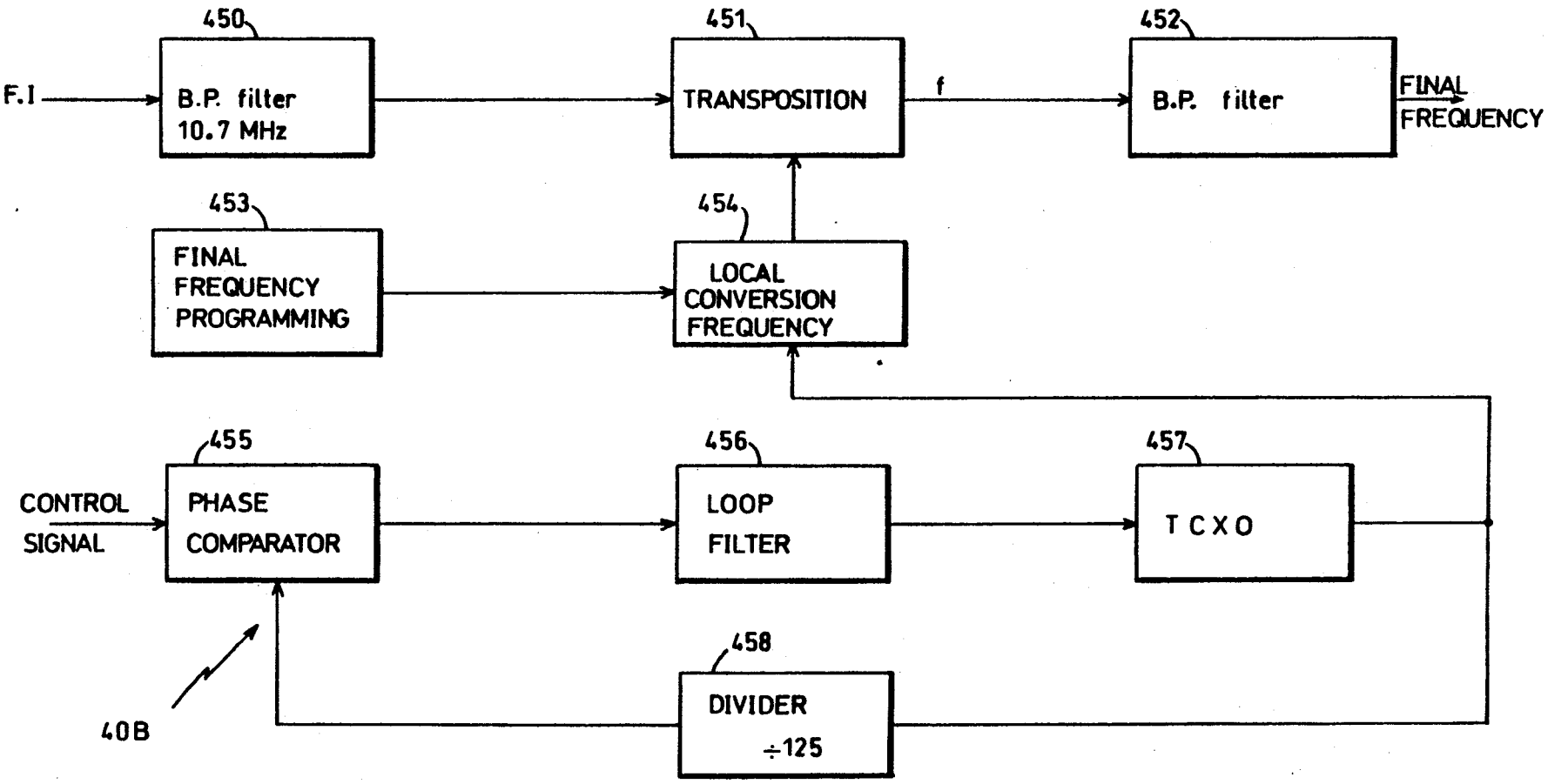
FIG. 6 is a functional block diagram of the analog part of the modulator encoder shown in FIG. 4.

FIG. 5 is a diagram showing the various digital processing steps and FIG. 6 is a diagram showing the various analog processing steps.

Referring to FIG. 5, the SNE digital signal in the form of a serial bit stream is received by a frame receiver 400 complying with the EBU/AES standard. The frame receiver separates the right and left channels in the SNE signal to deliver in parallel two series of digital values RV and LV respectively representing the right channel and the left channel, each value being coded on 16 bits. The frame receiver 400 also outputs the subcarrier synchronization signal SSP. A timing signal representative of the sampling frequency Fe is recovered by the frame receiver receiving the SNE signal by counting and detecting the bits received. As already mentioned, the SSP signal is a synchronization pulse signal at 1 kHz.

The frame receiver 400 is designed to operate at a frequency Fe whose nominal value is set at 32 kHz, for example, and a phase-locked loop controlled by the timing signal is used to supply to the frame receiver a timing signal representing the smoothed sampling frequency Fe and having a short term stability greater than that of the recovered frequency Fe. All processing is synchronized to the smoothed frequency Fe. The phase-locked loop comprises a phase comparator 431 receiving the timing signal on a first input, a loop filter 432 having its input connected to the output of the phase comparator and adapted to stabilize the loop, a temperature compensated oscillator (TCXO) 433 oscillating at a reference frequency of 40.96 MHz and having its input connected to the output of the loop filter and a reference frequency divider 440 having its input connected to the output of the temperature-compensated oscillator.

The divider 440 is connected to the frame receiver 400 and to a second input of the phase comparator 431, the smoothed frequency Fe supplied by the divider 440 being obtained by dividing by 1 280 the reference frequency supplied by the oscillator. The smoothed frequency Fe therefore has a nominal value of 32 kHz which is the nominal value of the baseband signal sampling frequency Fe.

The digital bit streams LV, RV from the frame receiver 400 must be in the form of a stereo digital multiplex enabling voltage/frequency conversion. Also, the digital bit streams LV, RV from the frame receiver 400 represent signals digitized at the frequency Fe of 32 kHz. Time sampled, these signals are of the frequency periodic type and consequently occupy the full frequency spectrum in the form of image frequencies around multiples of the sampling frequency Fe (64 kHz, 96 kHz, 128 kHz, etc). To clear space in the frequency spectrum, to build the stereo digital multiplex, two stages 401 and 403 of oversampling are applied to the digital bit streams LV and RV. Each oversampling stage eliminates unwanted image frequencies from the wanted part of the frequency spectrum reserved for building the multiplex.

Oversampling the digital bit streams LV and RV reconstructs the missing samples between the known samples for each of the right and left channels. Oversampling uses an FIR filter whose cut-off frequency is the limit of the wanted frequency spectrum. It does not result in any increase in accuracy since the original description of the baseband signal is sufficient for a digital-to-analog converter (DAC) to be able to reconstitute the signal perfectly. Note, however, that for constant computation power it is necessary to arrive at a compromise between the quality of the oversampling, in other words the number of coefficients of the FIR filter, and the oversampling factor. One solution is to regard the oversampling FIR filter as operating at the frequency required at its output. In this case the samples missing at the filter input are assumed to be null samples. In this way each sample at the filter output is computed by convolution of non-null input samples with 1/n of the FIR filter coefficients, where n is the oversampling factor. The coefficients of the FIR filters used are computed using the REMETZ algorithm published in "Traitment numerique du signal" ("Digital signal processing") by BELLANGER published by MASSON in its "Colléction Technique et Scientifique de Télécommunications" ("Telecommunications Technology and Science Collection"), third edition.

A first oversampling stage 401 (oversampling factor $P_1$) is activated on receipt of an interrupt signal IRQA in corresponding relationship to the timing signal of the SNE source signal samples supplied by the frame receiver 400. The oversampling stage 401 computes from the two initial digital bit streams VGN and VDN two new digital bit streams still representing the right and left channels but comprising $P_1$.Fe samples per second. This first processing is carried out by a Motorola XSP 56001 dedicated signal processor programmed for two times oversampling. Standardized pre-emphasis of 50 s is applied in a stage 402 to the digital bit streams output by the first oversampling stage 401. The oversampling stage 401 and the pre-emphasis stage 402 use a program implementing the following functions known to those skilled in the art:

two times oversampling of the stereo input at 32 kHz by transversal filtering using 176 coefficients.

"J 17" de-emphasis and 50 μs pre-emphasis by first order recursive filtering at 64 kHz.

After the pre-emphasis stage 402, a second oversampling stage 403 (oversampling factor $P_2$) processes each of the two digital bit streams as shown in FIG. 5. The processing is carried out by a second and identical dedicated signal processor programmed for four times oversampling ($P_2=4$).

The second oversampling stage 403 produces two digital bit streams LV' and RV' respectively representing the left and right channels and each comprising $P_1.P_2$.Fe values per second. A stereo digital multiplex builder 404 operates after the second oversampling stage to effect the operation:

$$(LV'+RV')/2+\{(LV'-RV')(/2\}\times P+Q)$$

in which P represents a carrier frequency of 38 kHz and Q represents a pilot frequency of 19 kHz. This operation is applied to each sample of the digital bit streams LV' and RV' at the frequency $P_1\times P_2\times Fe=256$ kHz.

The various processing stages are synchronized by virtue of the fact that in each stage the computation is carried out in less time than is allocated for the computation, so that at the last stage there is always the correct number of samples per unit time.

In parallel with the synchronization of the digital data stream in the various processing stages described above and in order to ensure total identity of FM deviation due to the pilot and subcarrier frequencies, it is necessary to synchronize the subcarrier signal P (at 38 kHz) and the pilot signal Q (at 19 kHz). As the subcarrier and pilot signals P and Q are not transmitted in the SNE signal, one solution is to synthesize them at the transmitter 30. The subcarrier and pilot signals P and Q are obtained by direct digital synthesis using a PROM containing, for example, 256 values obtained by constant pitch sampling of a sinusoid. By reading one address in 19 or one address in 38 of the PROM, a frequency of 19 kHz or 38 kHz is synthesized in the manner well known to those skilled in the art. The 1 kHz frequency of the SSP signal makes it possible to check periodically for each complete run through the PROM and for both read increments that the digital synthesis begins at the same PROM address and at the same time for each transmission. For example, at intervals of 1 ms, on receiving the SSP signal, the PROM 0 address is imposed as the synthesis reference.

The second processor circuit is programmed to synthesize the subcarrier signal P and the pilot signal Q using its internal PROM.

In this way the digital multiplex obtained at the output of the multiplexer stage 404 is identical at all transmitters 30.

The insertion of the program or of additional signals into the multiplex can be carried out in the same way by synthesizing an additional subcarrier (in processing stage 412). However, the synchronous digital processing system must make provision for the addition of a further subcarrier because of the dedicated nature of each program loaded into the various processor circuits. The oversampling stage 403 and the multiplexer stage 404 use a program implementing the following functions known to those skilled in the art:

four times oversampling of the multiplexed stereo signal by a transversal filter using 44 coefficients, generating subcarriers required for 19 kHz, 38 kHz multiplexing by direct digital synthesis, and controlling the phase of the subcarriers by synchronizing the digital synthesis to the external pilot signal SSP and building the "baseband" multiplex.

A digital oversampling stage 405 processes the digital multiplex to provide the multiplex in the form of an augmented series of samples comprising Fh samples/-second where $Fh=Q\times P_1\times P_2\times Fe$. The oversampling stage 405 is a third dedicated signal processor identical to the first processor and programmed for eight times oversampling of the digital multiplex ($Q=8$). This final oversampling stage eliminates image frequencies of frequencies which are multiples of $P_1\times P_2\times Fe$. All the operations described above amount to overall oversampling at 64 times the sampling frequency Fe, that is a final frequency Fh of 2.048 MHz. The oversampling stage 405 uses a program implementing the following functions:

four times oversampling of the stereo input by a transversal filter using 20 coefficients, and generating an interpolated sample between successive values resulting from the previous oversampling by linear interpolation.

The multiplex obtained after these processing stages is in the form of a series of 16-bit words delivered at the frequency Fh.

Figure 7:
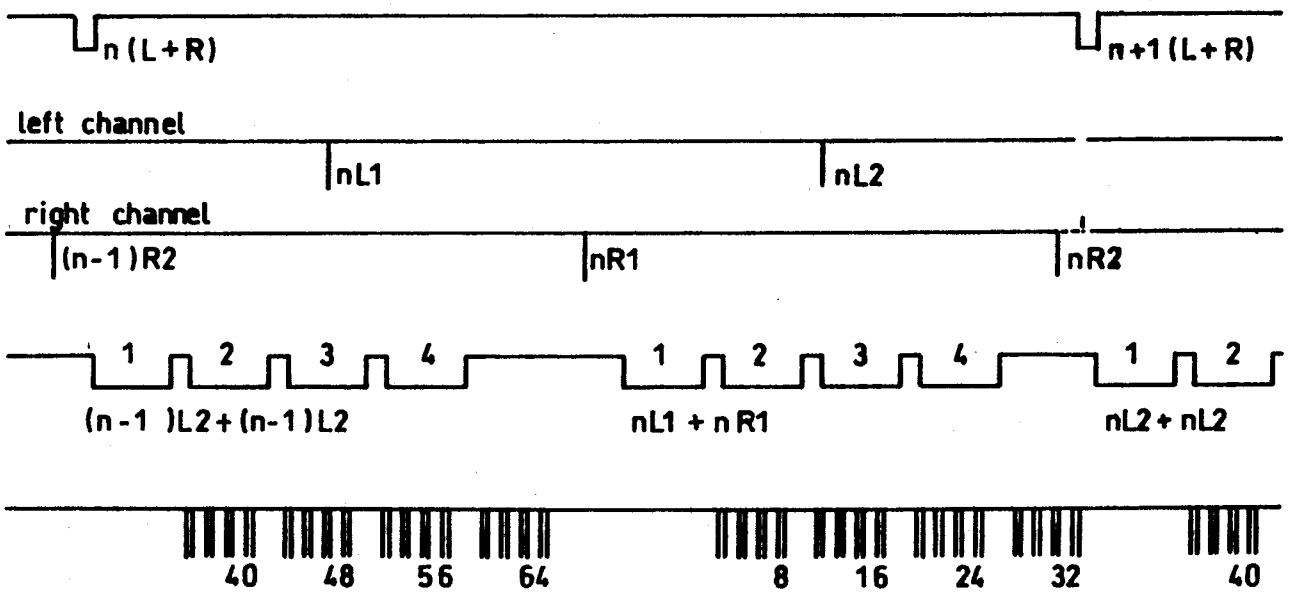
FIG. 7 is a timing diagram for the computations carried out in the various digital processing steps by the digital part of the modulator encoder in accordance with the invention.

FIG. 7 is a timing diagram for the computations carried out in the various processing stages. As shown in this figure, the sample clock or interrupt signal provides 32 000 synchronization pulses every second, this signal representing the sampling frequency Fe. On each synchronization pulse two right channel, left channel pulses n (L+R) are processed in the two times oversampling stage 401. At the output from this stage 401 two right channel samples and two left channel samples nL1, nL2, nR1, nR2 are obtained. The samples ng1 and nd1 are then processed in the second oversampling stage 403 and in the multiplexer stage 404 to provide the multiplex samples nL1+nR1 with the subscripts 1, 2, 3, 4 corresponding to four periods of serial transmission of the four times oversampled signals. Each sample nL1+nR1 with subscripts from 1 to 4 is processed in the eight times oversampling stage 405 to provide eight samples represented by the blocks 8, 16, 24, 32. The samples represented by the blocks 40, 48, 56, 64 are computed in the same way by 32 times oversampling the samples nL2 and nR2.

Figure 8:
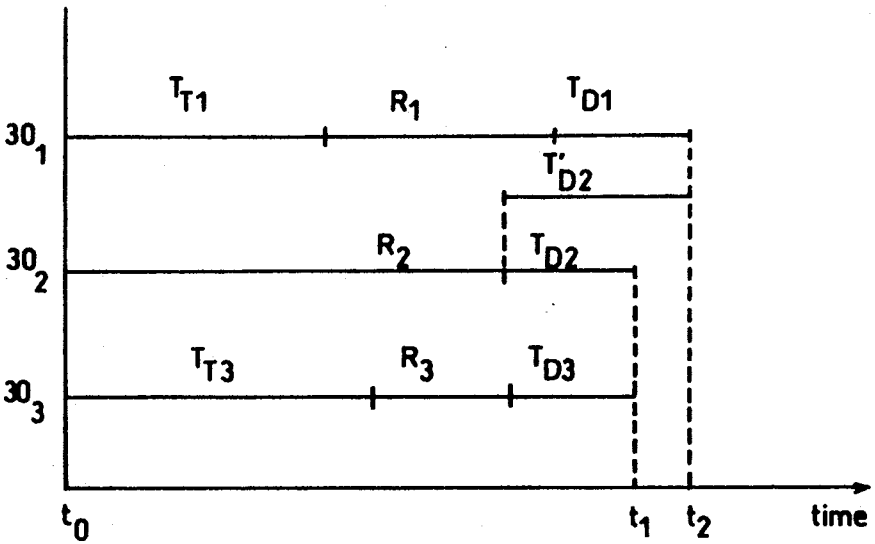
FIG. 8 is a timing diagram for the propagation of a signal from the production site to the critical areas.

To synchronize the phase of the final signals transmitted by the transmitters to the critical areas 35 when the protection ratio between adjacent transmitters is near 0 dB, the broadcasting of the final signal by each transmitter 30 is delayed by a predetermined time, as explained below. FIG. 8 is a timing diagram showing the propagation of a source signal from the production site to the critical areas. The example assumes that the production site is colocated with the transmitter $30_2$ and that the broadcast network comprises the three transmitters $30_1$, $30_2$ and $30_3$ from FIG. 1. This configuration is chosen as a non-limiting example.

Referring to FIG. 8:

$t_0$ represents the time reference when the source signal is produced.

$t_1$ represents the time the signals reach the area $35_2$.

$t_2$ represents the time the signals reach the area $35_1$.

$T_{t1}$ represents the propagation time needed to transmit the source signal from the production site 10 (transmitter $30_2$) to transmitter $30_1$.

$T_{t3}$ represents the propagation time needed to transmit the source signal from the production site 10 to transmitter $30_3$.

It is assumed that because of the structure of the network the propagation time needed to transmit the source signal from the production site 10 to the transmitter $30_2$ is negligible. The propagation times are computed from the geographical positions of the transmitters relative to the production site and the transmission speed of the signal in the transmission medium 20. In the case of a microwave link, the transmission time is substantially 10/3 s/km.

Still referring to FIG. 8:

$T_{d1}$ represents the propagation time needed to broadcast the final frequency modulation signal from the transmitter $30_1$ to the critical area $35_1$.

$T'_{d2}$ represents the propagation time needed to broadcast the final frequency modulation signal from the transmitter $30_2$ to the critical area $35_1$.

$T_{d2}$ represents the propagation time needed to broadcast the final frequency modulation signal from the transmitter $30_2$ to the critical area $35_2$.

$T_{d3}$ represents the propagation time needed to broadcast the final frequency modulation signal from the transmitter $30_3$ to the critical area $35_2$.

These propagation times are computed experimentally on the basis of a determination of the geographical location corresponding to the critical area in which mutual interference between the two transmitters is maximum when the network is not configured in synchronized mode. Each critical area can also be located according to the power of the transmitter in question, the topography of the terrain and the directional properties of the transmitter antennas.

Specific time-delays are applied to the broadcasting of the frequency modulation signal at each transmitter connected to the production site 10 in the manner now to be described. At a first transmitter, the transmitter $30_3$, for example, a broadcast time-delay is applied which represents a guard time-delay R3 so that, as shown in that part of FIG. 8 which refers to the transmitter $30_3$, the propagation time of the source signal from the production site 10 via the transmitter $30_3$ to the critical area $35_2$ is equal to $T_{t3}+R3+T_{d3}$.

Substantially at the center of the critical area $35_2$ the signals transmitted by the transmitters $30_2$ and $30_3$ must be in phase. The phases of these two signals are synchronized by introducing a broadcast time-delay R2 at the transmitter $30_2$ so that the propagation time of the source signal from the production site 10 via the transmitter $30_2$ to the critical area $35_2$ (which is $R2+T_{d2}$) is equal to the propagation time of the source signal from the production site 10 via the transmitter $30_3$ to the critical area $35_2$ (which is $T_{t3}+R3+T_{d3}=t_1$) as shown in that part of FIG. 8 which refers to the transmitter $30_2$.

Likewise, the signals transmitted by the transmitters $30_1$ and $30_2$ are in phase substantially at the center of the critical area $35_1$. If R1 is the broadcast time-delay to be applied to the signal at the transmitter $30_1$:

$$R2+T'_{d2}=T_{t1}+R1+T_{d1}=t2$$

It is therefore a simple matter to determine the time-delays to be applied on broadcasting the frequency modulated signal at each transmitter to guarantee that the transmitted signals will be in phase substantially at the center of the critical areas.

A synchronizer 420 receiving a series of binary words constituting the multiplex stores them temporarily and restores them in their order of arrival at the frequency Fh. The temporary storage of the binary words in the synchronizer 420 is equivalent to delaying the transmission of the final signal that will be constituted from this series of binary words. The synchronizer 420 may comprise a double ported (read and write) memory, for example, the time difference between writing data into memory and reading it representing a time-delay with an accuracy of 1/Fh. Depending on the size of the double ported memory, it is a simple matter for a delay programmer 430 to program a time-delay of up to 1 ms, for example, if the double ported memory used can store 2 048×16-bit words.

As shown in FIG. 5, the synchronizer 420 is controlled by the frequency Fh generated by the phase-locked loop 431, 432, 433, 440. This frequency is equivalent to the overall input frequency of the binary words from the oversampling stage 405.

The digital multiplex delayed in the synchronizer stage 420 is transmitted at the frequency Fh to a digital modulator 421 in the form of a synthesizer using a read only memory containing N (65 536) digital values representing the samples for one complete period of a sinusoid, each value being coded on 16 bits.

The carrier frequency Fp generated by the frequency synthesizer is directly dependent on the address increment NO with which the memory is read. Each value of the series of values constituting the multiplex at the output of the synchronizer 420 is added modulo N to the increment NO to constitute a new increment. The value of the new increment is then added modulo N to the current memory address. This determines the series of memory addresses for reading the digital values. A voltage-frequency conversion scaling factor is obtained by linking 13 MSB bits of each binary word of the series of binary words constituting the multiplex to 13 LSB bits of the address word for reading the memory containing the sinusoid samples, for example.

The synthesizer frequency increment being determined by the ratio Fh/N (31.25 Hz), the resulting maximum deviation of the carrier frequency Fp before peak limiting is 256 kHz ($31.25\times2^{13}$), that is 128 kHz deviation either side of the carrier frequency. This produces a margin of approximately 4.6 dB relative to the standardized maximum deviation of ±75 kHz.

Because the digitized source signal is digitally modulated, the same frequency modulation and the same carrier frequency are guaranteed at each transmitter site.

The digital signal representing the modulated carrier frequency Fp at the output of the digital modulator 421 is then multiplied with a frequency Ft to transpose the modulation frequency.

Allowing for the modulation gain introduced by the frequency modulation, the quantizing accuracy on 16 bits of each binary word from the digital modulator 420 is no longer needed and consequently the multiplication with the frequency Ft is limited to the 12 MSB bits of each word. To give a concrete example, the values chosen for the frequencies Fp and Ft may be respectively 460 kHz and 10.24 MHz.

At the output of the digital transposer 422 the 12-bit words produced by this multiplication are delivered at the frequency Ft and converted to twice this frequency by a 12-bit digital-to-analog converter (DAC) 423.

A conversion frequency is chosen, for example, equal to exactly twice the frequency to be converted to enable mutual exchange about the frequency Ft of the frequencies {Ft+Fp} and {Ft−Fp} which result from the multiplication. The frequencies {Ft+Fp} and {Ft−Fp} being respectively higher than and lower than the frequency Ft by the same amount, which is half the sampling frequency for the DAC 423, they each assume the position of the other, which enables correct digital-to-analog conversion in spite of a sampling frequency 2Ft which is less than twice the frequency Ft+Fp, in other words the intermediate frequency of 10.7 MHz.

Referring to FIG. 5, the frequencies Fh, Ft and 2Ft are obtained at the output of the divider 440 of the phase-locked loop synchronized to the frequency Fe. Thus all these frequencies are synchronized to each other and to the frequency Fe.

A control signal is obtained according to the same principle by frequency division at the phase-locked loop on Fe, this control signal being required to synchronize the analog transposition to the final frequency of the signal to be transmitted.

The frequencies 2Ft, Ft and Fh, the frequency of the control signal and the smoothed frequency Fe are obtained by dividing the reference frequency respectively by 2, by 4, by 20, by 1 024 and by 1 280, so that 2Ft=20 480 kHz,
Ft=10 240 kHz,
Fh=2 048 kHz,
control signal frequency=40 kHz,
Fe=32 kHz.

Referring to FIG. 6, the analog signal at the intermediate frequency and the control signal are transmitted to the analog part 40B of the synchronizable modulator encoder. The analog signal from the digital-to-analog converter is filtered by a bandpass filter 450 centered on 10.7 MHz to eliminate all unwanted image frequencies. After the final frequency of the transmitter is programmed (453), the transposition to the final carrier frequency f is carried out in the conventional analog way (451). To preserve the synchronization with the smoothed frequency Fe a phase-locked loop 455, 456, 457, 458 slaves an oscillator (TCXO) 457 used as a reference to obtain a local conversion frequency (454). The loop is locked onto the control signal from the divider 440, the control signal being in turn phase-locked to the sampling frequency signal Fe.

The signal after transposition to the final frequency is filtered by a bandpass filter centered on the final transmission frequency which is between 88 and 108 MHz.

The method described above can be applied without any modification to the infrastructure of existing networks. It suffices to use digital transmission achieving synchronous distribution of the baseband signal, a synchronized digital encoder and a digital modulator implementing the functions described above. Using a synchronization method of this kind, a non-synchronized network can be given the following properties:

- no drift in initial specifications without maintenance adjustments,
- linear voltage/frequency conversion and compliance with the maximal frequency deviation.

Of course, the invention is not limited to the embodiment described above and variations thereon may be put forward without departing from the scope of the invention.

There is claimed:

1. A method for synchronizing receiver/transmitter units in a synchronized broadcast network comprising a main transmitter transmitting a stereophonic audio source signal to a plurality of receiver/transmitter units remote from each other and from the main transmitter and the receiver/transmitter units broadcasting the stereophonic audio signal using frequency modulation, the method comprising the following steps:

in the main transmitter:
- digitizing the audio source signal by sampling it at a predetermined sampling frequency so as to provide a digitized signal;
- encoding a subcarrier synchronization signal in said digitized signal;
- transmitting said digitized signal to the receiver/-transmitter units;

and in each receiver/transmitter unit:
- receiving said digitized signal;
- decoding said digitized signal to obtain said subcarrier synchronization signal;
- synthesizing subcarrier and pilot signals from said subcarrier synchronization signal which was obtained by said decoding;
- utilizing said subcarrier and pilot signals to generate a digital mutiplex signal representing said stereophonic signal;
- deriving a reference signal, representing said sampling frequency, from the received digitized signal;
- performing a succession of digital processing steps on the digital multiplex signal including deriving a carrier from the reference signal and digitally modulating said carrier and digital-to-analog converting a result of the digital modulating;

delaying said digital multiplex signal for a predetermined time in order to phase synchronize the receiver/transmitter units;

frequency dividing said reference signal so as to generate other synchronization signals;

synchronizing said digital processing steps by said other synchronization signals in order to obtain identical digital modulation of a like carrier frequency for all the receiver/transmitter units; and transposing a result of the digital-to-analog converting to a final frequency, derived from the reference signal, for broadcasting an analog audio signal using frequency modulation with a same modulation, phase angle and carrier frequency at all receiver/transmitter units.

2. Network for synchronized frequency modulation broadcasting of a stereophonic signal comprising a main transmitter in which a stereophonic source signal is generated and a plurality of receiver/transmitter units remote from each other and from the main transmitter receiving the stereophonic source signal to broadcast it using frequency modulation of a single carrier frequency, wherein the main transmitter comprises:

means for digitizing the stereophonic source signal by sampling it at a predetermined sampling frequency;

means for generating a synchronization signal;

means for encoding the digitized stereophonic source signal and the synchronization signal in the form of a digital broadcast signal which is transmitted to the receiver/transmitter units;

and each receiver/transmitter unit comprises:

means for receiving the digital transmission signal;

decoding means connected to the receive means to reconstitute the digitized stereophonic signal, the synchronization signal and a reference signal from the digital transmission signal, the reference signal representing said sampling frequency;

synthesizer means for generating synchronized synthesized carrier signals from the synchronization signal;

digital coding means receiving the digitized stereophonic signal and the synthesized carrier signals to provide a digital multiplex signal;

delay means for delaying said digital multiplex signal by a predetermined time;

means for providing an intermediate frequency carrier signal, a control signal and a digital-to-analog conversion signal, each said intermediate frequency carrier signal, control signal and conversion signal being synchronized with a submultiple of the reference signal;

digital modulation means receiving said intermediate frequency carrier signal and controlled by the delayed digital multiplex signal to provide a digital signal at the modulated intermediate frequency;

digital-to-analog converter means, connected to the digital modulation means and receiving the digital signal at the modulated intermediate frequency to provide an analog signal at the same intermediate frequency modulated in response to the digital-to-analog conversion signal;

transposition means controlled by the control signal to transpose the analog signal and the modulated intermediate frequency into a transmit analog signal at a final transmission frequency; and transmission means connected to the transposition means to broadcast said transmit analog signal using frequency modulation with the same modulation, phase and carrier at each receiver/transmitter unit.

3. Synchronous broadcast network according to claim 2 wherein the digital coding means comprise means for oversampling the digital transmit signal.

4. Synchronous broadcast network according to claim 2 in which the delay means comprise double ported read and write memory means for storing digital data constituting the digital multiplex signal and restoring said data by shifting memory read/write addresses with a programmable time-delay.

* * * * *